United States Patent [19]

O'Gorman

[11] 4,434,783

[45] Mar. 6, 1984

[54] CONTROLLED FIREPLACES FOR CONCURRENTLY VARYING COMBUSTION AIR AND CONVECTED AIR

[76] Inventor: Michael C. O'Gorman, 16 The Lane, Fritwell nr. Bicester, England

[21] Appl. No.: 333,864

[22] PCT Filed: May 1, 1981

[86] PCT No.: PCT/GB81/00080

§ 371 Date: Dec. 16, 1981

§ 102(e) Date: Dec. 16, 1981

[87] PCT Pub. No.: WO81/03218

PCT Pub. Date: Nov. 12, 1981

[30] Foreign Application Priority Data

May 2, 1980 [GB] United Kingdom ..... 8014804

[51] Int. Cl.[3] ..... F24B 7/00

[52] U.S. Cl. ..... 126/121; 126/132; 126/77

[58] Field of Search ..... 126/121, 123, 131, 143; 237/51

[56] References Cited

U.S. PATENT DOCUMENTS

| | | | |
|---|---|---|---|
| 505,237 | 9/1893 | Sheldon | 126/131 X |
| 2,283,790 | 5/1942 | Cage | 126/121 |
| 3,180,332 | 4/1965 | Grushkin | 126/121 |
| 3,190,282 | 6/1965 | Bauer | 126/131 |
| 4,170,219 | 11/1979 | Hansen et al. | 126/121 |
| 4,254,756 | 5/1981 | Wells | 126/121 |
| 4,266,525 | 5/1981 | Hall | 126/121 |

FOREIGN PATENT DOCUMENTS

| | | |
|---|---|---|
| 2013707 | of 0000 | Fed. Rep. of Germany . |
| 2273238 | of 0000 | France . |
| 572598 | of 0000 | Switzerland . |

*Primary Examiner*—Samuel Scott
*Assistant Examiner*—Carl D. Price
*Attorney, Agent, or Firm*—Shapiro and Shapiro

[57] ABSTRACT

Convected air from the room to be heated enters two first air spaces (10) through two front inlets (12) and circulates through passageways (13) between inner and outer casings forming the fireplace and re-enters the room through front air outlets (14). Cold fresh air from outside the room enters a second air space (14), between the two first air spaces (10), and can be fed into the room through a control vent (16) for promoting combustion within the fire and/or can be fed into the first air spaces (10) so as to supplement the convected air flowing through the passageways (11).

7 Claims, 11 Drawing Figures

CONTROLLED FIREPLACES FOR CONCURRENTLY VARYING COMBUSTION AIR AND CONVECTED AIR

TECHNICAL FIELD OF THE INVENTION

The invention relates to fireplaces in which control means are provided for varying the flow of combustion air to a fire within the fireplace and the control means are capable of varying the flow of convected air around the fireplace.

BACKGROUND ART

In a known controlled-combustion fireplace, sold under the trade mark "BAXI", ducting which opens below the hearth extends away from the fireplace to an inlet opening which permits the ingress of fresh air from outside the room being heated by the fireplace. Control of this fresh air flow is effected by a control vent in the ducting, below the fireplace.

With this form of construction, the fresh air is intended solely for combustion purposes and flows straight through the fireplace at a rate depending upon the size of the opening provided by the control vent. The heat derived from such a fireplace is transferred mainly by radiation.

One known convected air fireplace, sold under the trade mark "JET MASTER", in which an attempt is made to solve this problem, comprises an inner casing, for accommodating a fire and having an open front, a rear panel, an open top panel, a bottom panel and two side panels; outer casing means enclosing at least one first air space below the inner casing and passage means for air extending upwardly from the or each first air space along at least one side panel of the inner casing; front air inlet means opening into the first air space, at the front of the fireplace; and front air outlet means communicatively connected to the passage means and opening at the front of the fireplace, above the level of the front air inlet means.

Convected air which is drawn in from the room to be heated through the front air inlet means at the bottom of the fireplace flows back into the room through the front air outlet means at the top of the fireplace. With this form of fireplace, the heat derived from the fire is greatly increased in that it depends not only on radiation, but also on the heat carried by convected air currents. However, warm air is drawn from the room to support combustion and this causes cold draughts to flow towards the fireplace from doorways, windows and other openings in the room, thereby cooling the backs of people sitting in front of the fireplace and it has been found that the induced convection currents concentrate this flow of cold fresh air along the floor of the room where it is most uncomfortable to the people sitting in front of the fireplace.

DISCLOSURE OF THE INVENTION

The invention as claimed is intended to provide a fireplace in which the defects of known fireplaces are avoided and, in particular, solves the problems associated with the flow of cold fresh air into the fireplace while, at the same time, providing for the transfer heat by convection currents. This is achieved by providing a fireplace in which the outer casing means enclose a second air space below the inner casing; back inlet means open into the second air space at the rear of the fireplace; a control vent opens from the second air space, for controlling flow of air from the second air space into the inner casing; and valve means are disposed within the second air space for use in conjunction with the control vent for varying the flow of air from the back air inlet means into the first air space below the inner casing.

Thus, according to the invention, there is provided a fireplace, for concurrently controlling the flow of combustion air and convected air, comprising an inner casing, for accommodating a fire and having an open front, a rear panel, an open top panel, a bottom panel and two side panels; outer casing means enclosing first and second air spaces below the inner casing and passage means for convected air extending upwardly from the or each first air space along at least one side panel of the inner casing; front air inlet means opening into the or each first air space, at the front of the fireplace; front air outlet means communicatively connected to the passage means and opening at the front of the fireplace, above the level of the air inlet means; back air inlet means opening into the second air space, at the rear of the fireplace; a control vent which opens from second air space for controlling the flow of air from the second air space to the inner casing; and valve means disposed within the second air space for use in conjunction with the control vent for varying the flow of air from the back air inlet means into the first air space below the inner casing.

With a fireplace such as this, the back air inlet means may extend away from the fire so as to allow fresh air to be fed at a controlled rate without inducing cold air draughts on the backs of people sitting in front of the fireplace. The control vent opens from the second air space at the front of the fireplace and so, for maximum flow of cold fresh air into the fireplace, the control vent is opened fully and the valve means are closed fully. Cold fresh air therefore flows from outside directly into the room at the front of the fireplace and, from there, this fresh air is able to flow back into the fireplace so to stimulate combustion. In this mode, discomfort to people sitting in front of the fire is avoided by virtue of the fact that excess cold fresh air which does not flow into the fireplace is diverted into the front air inlet means by the convected air currents provided by the fireplace. Thus, control of a fire within the fireplace may be effected by varying the opening of the control vent.

In addition, even when the control vent is more or less fully closed, flow of fresh air into the room can be controlled by varying the opening of the valve means. This varies the flow of cold fresh air from the second air space into the or each first air space so as to vary the proportion of fresh air in the air flowing through the passage means and issuing from the front air outlet means as heated convected air.

An embodiment of the invention, optionally incorporating further advantageous features, is hereinafter described, by way of example, with reference to the accompanying drawings.

EXEMPLARY MODES FOR CARRYING OUT THE INVENTION

Figure 1:
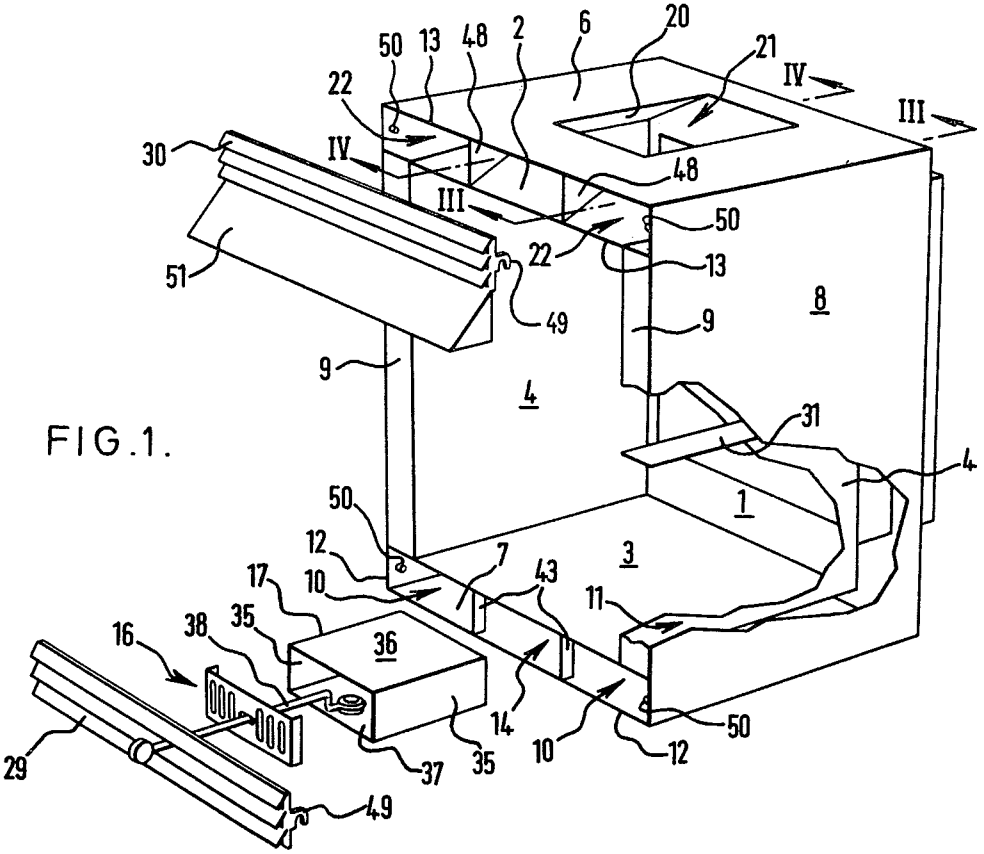
FIG. 1 is a schematic "exploded" and partly cutaway isometric view of a fireplace in accordance with the invention.
Figure 2:
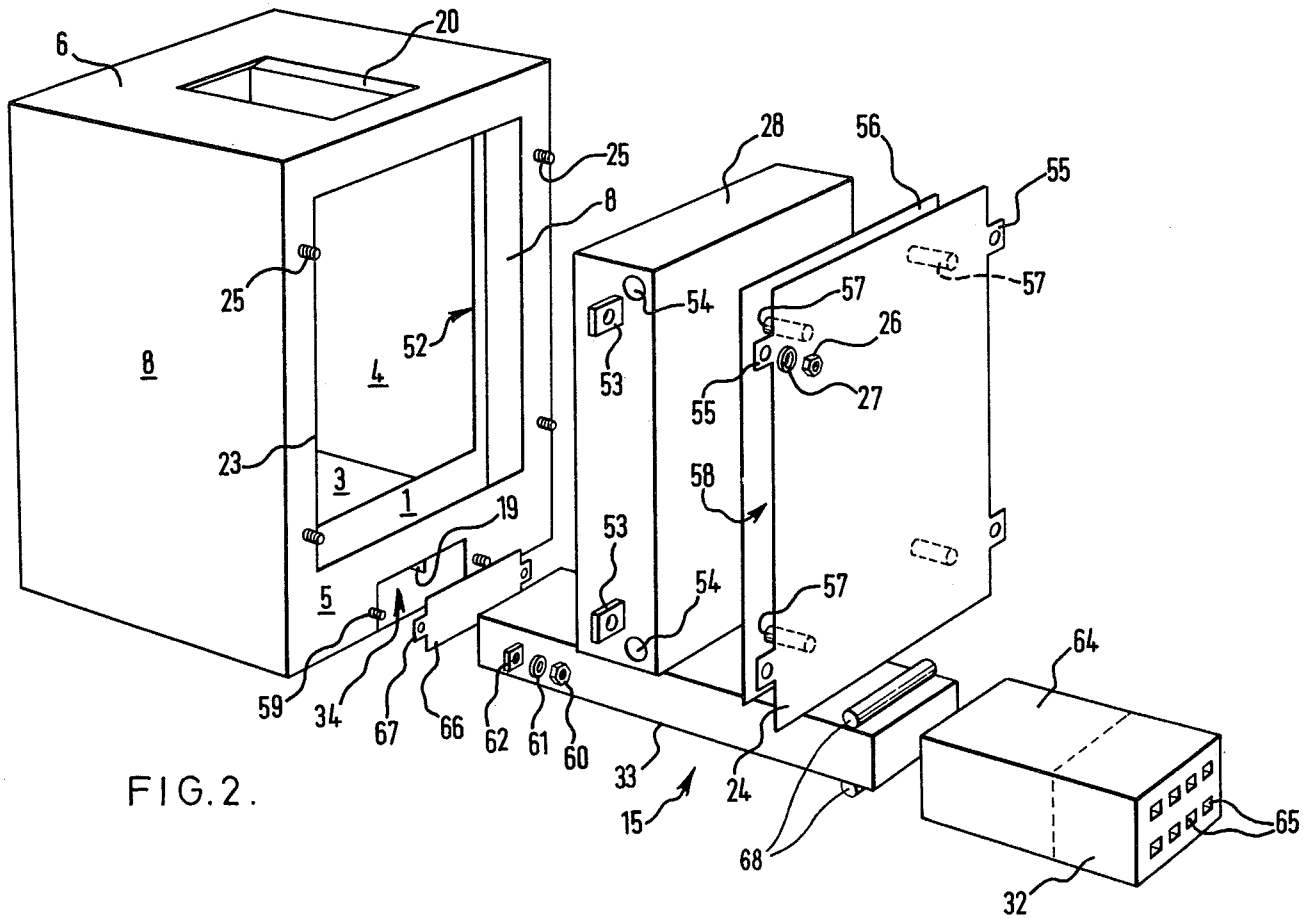
FIG. 2 is a schematic "exploded" isometric view of the fireplace shown in FIG. 1, as seen from the rear.

As shown in FIGS. 1 and 2, the illustrated embodiment of the invention comprises an open-fronted inner casing having a rear panel 1, an open top panel 2, a bottom panel 3 and two side panels 4 for accommodating a fire. The inner casing is surrounded by an outer casing comprising an outer rear panel 5, an open top panel 6, a bottom panel 7, two side panels 8 and two front panels 9. Two first air spaces 10 are separated from a central second air space 14 by means of two partitions 19 and communicate, respectively, with passageways 11 which extend, respectively, on opposite sides of the fireplace between the side panels 4 and 8 of the inner and outer casings. These passageways 11 respectively communicate with discharge passages 22 disposed between the open top panel 2 of the inner casing and the outer open top panel 6 of the outer casing.

As shown, front air inlets 12 open into the first air spaces 10 at the front of the fireplace so as to permit air from the room to pass through a lower grill 29. This air re-emerges through front air outlets 13, which open from the discharge passages 22, and flows through an upper grill 30, back into the room. Baffles 31, which also stiffen the side panels 4 and 8 of the inner and outer casings, ensure that the inlet air sweeps over as much of the inner casing as possible before issuing from the front air outlets 13.

Figure 3:
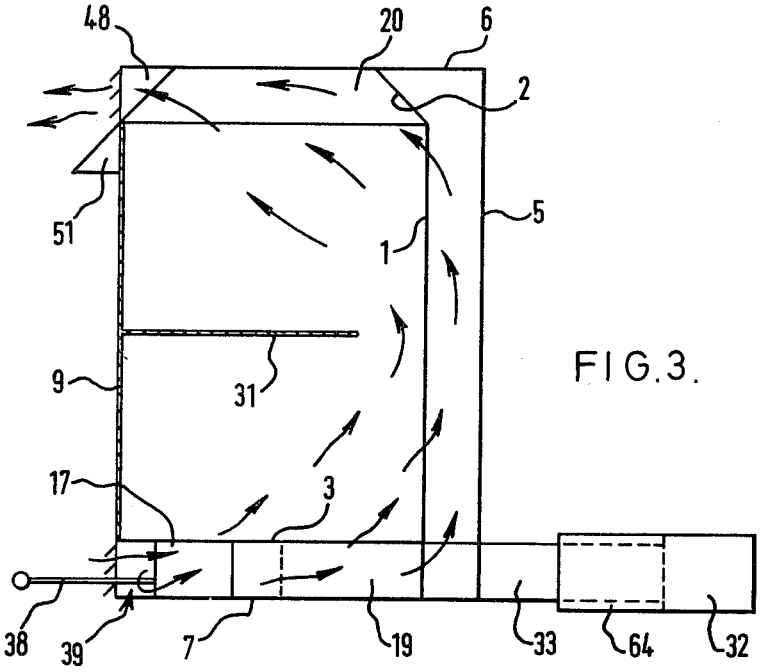
FIGS. 3 and 4 are sectional side elevations taken across the Sections III—III and IV—IV shown in FIG. 1.
Figure 4:
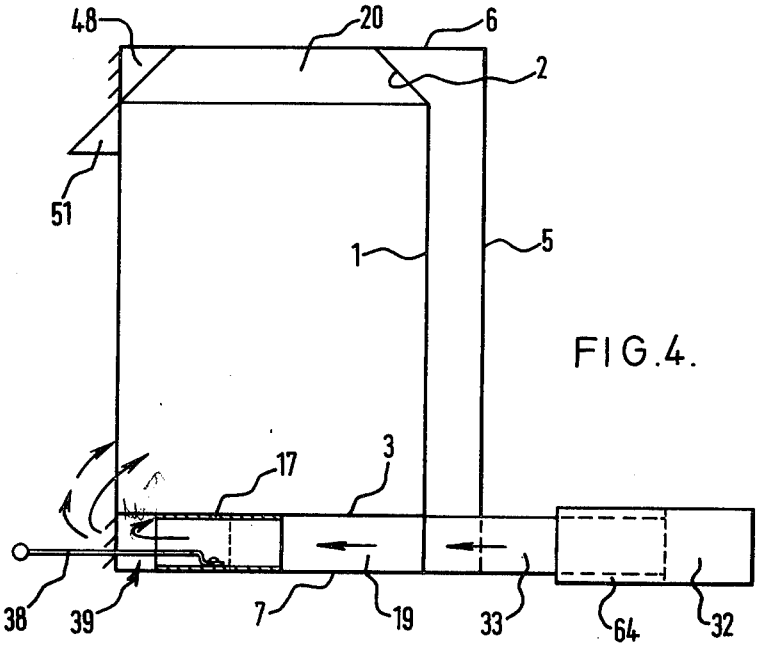

Back air inlet means 15, in the form of a standard air brick 32 and a duct 33 extending from the air brick 32 through an aperture 34 in the outer rear panel 5 and into the second air space 14, allow cold fresh air to flow from outside the room to be heated by the fireplace and into the second air space 14. By varying the setting of a control vent 16, it is possible to vary the amount of cold fresh air which flows from the second air space 14 and into the room to be heated by the fireplace and, from there, back into the fireplace so as to control combustion within the fireplace. However, in addition, it is also possible to control the flow of fresh air into the room by means of a valve 17. Thus, as shown in FIG. 1, the valve 17 comprises two side members 35 which are supported by rigid top and bottom members 36 and 37. A control rod 38, which extends through the lower grill 29 and the control vent 16, is pivotally connected to the bottom member 37 of the valve 17 so as to permit the valve 17 to be moved backwards and forwards along the second air space 14 so as to vary the opening 39 between each first air space 10 and the second air spaces 14 because of the fact that, as shown in FIGS. 3 and 4, the partitions 19 do not extend across the whole depth of the bottom panel 3 of the inner casing. Thus, by varying these openings 39 it is possible to vary the proportion of fresh air flowing from the first air spaces 10 through the passageways 11 to the discharge passages 22 and out through the front air outlets 13.

Figure 5:
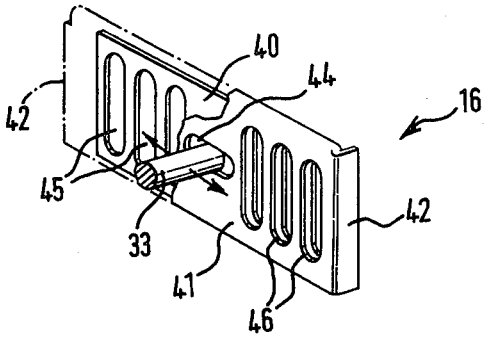
FIG. 5 is a schematic and partly cut-away isometric view of a control vent forming part of the fireplace shown in the other figures.

As shown in FIG. 5, the control vent 16 comprises inner and outer apertured plates 40 and 41. The upper and lower edges of the outer plate 41 are folded over so as to retain the inner apertured plate 40 in such a manner that the inner apertured plate 40 is able to slide laterally relative to the outer apertured plate 41. The two ends 42 of the outer apertured plate 41 are bent inwardly for attachment to support members 43 (FIG. 1) so that, as the control rod 38 is pivoted about its pivotal connection to the bottom member 37 of the valve 17, along a slot 44 formed in the outer apertured plate 41, the inner apertured plate 40 which is only provided with a through-hole for the control rod 38 is caused to move laterally, relative to the outer apertured plate 41, so as to vary the registration of the apertures 45 and 46 formed, respectively, in the inner and outer apertured plates 40 and 41. By means of this construction, it is possible to operate the control vent 16 and the valve 17 by means of a single, simply constructed and operated control rod 38.

Figure 6:
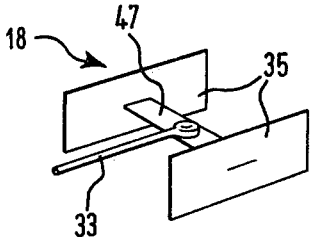
FIG. 6 is an isometric view of a second form of valve which could be used in place of the valve of the fireplace shown in FIGS. 1 to 4.

In an alternative form of valve 18, shown in FIG. 6, the two side members 35 are interconnected by a single cross-member 47 and, as shown, the control rod 38 is pivotally connected to the cross-member 47.

As shown more clearly in FIGS. 1, 3 and 4, the open top panel 2 of the inner casing is shaped in the form of a frustrum of a square pyramid so as to provide a convergent exit for smoke flowing from the fire into a chimney disposed above the fireplace. This means that the convected air is directed into the two discharge passages 22 on opposite sides of this opening and, in order to project the heated air issuing from the front air outlets 13 as far as possible into the room, blanking-off plates 48 are provided between the top panel 2 of the inner casing and the outer top panel 6.

As shown in FIG. 1, the lower and upper grills 29 and 30 are provided with hooks 49 which engage with lugs 50 projecting inwardly from the outer side panels 8. The upper grill 30 is formed with a hood 51 so as to streamline the flow of air from the room into the flow of smoke up the chimney and to prevent this air from deflecting the warm air from the front air outlets 13 upwards and thereby causing discolouration of the wall of the room immediately above the fireplace.

As shown in FIG. 2 the fireplace can advantageously incorporate a back boiler 28 extending through an opening 23 in the outer rear panel 5 into the space between the rear panel 1 of the inner casing and the outer rear panel 5 of the outer casing. As shown, to mount the back boiler 28 in intimate contact with the fire within the inner casing, the rear panel 1 of the inner casing is also formed with an opening 52. Four screw-threaded studs 24 extend rearwardly from the outer rear panel 5 and nuts 26 and washers 27 are engageable with these studs 25 to hold lugs 53 projecting laterally from the sides of the back boiler 28. Openings 54 for the flow of water into and out of the back boiler 28 are provided on one side of the back boiler 28 in order to connect the back boiler to a hot water system. If the connections to the hot water system are on the other side of the fireplace, the back boiler 28 is merely rotated about a horizontal axis extending from the front to the rear of the fireplace and the studs 25 and the lugs 53 are arranged so that in both configurations the back boiler 28 is securely supported within the space between the inner and outer casings. As shown in FIG. 2, when the back boiler 28 is not required, the studs 25 engage lugs 55 on a rear cover plate 24 which closes the opening 23 in the outer rear panel 5. This outer cover plate 24 is connected to an inner cover plate 56 by means of spacers 57 so as to close the opening 52 in the rear panel 1 of the inner casing. In this case, the space 58 between the outer cover plate 24 and the inner cover plate 56 serves as an additional passageway for the flow of convected air from the two first air spaces 10 to the discharge passages 22.

The outer rear panel 5 is also formed with an aperture 34 for the duct 33 of the back air inlet means 15. Screw-threaded studs 59 projecting rearwardly from the outer rear panel 5 co-operate with nuts 60 and washers 61 to hold apertured lugs 62, extending laterally of the duct 33 in position so that the front end of the duct 33 extends into the second space 14 bounded on opposite sides by the partitions 19. The air brick 32, provided with apertures 65, is connected to the outer end of the duct 33 by means of a sleeve 64 which is sealed to the duct 33 by means of asbestos sealing material 68. As shown, a cover plate 66 is provided with lugs 67 for closure of the aperture 34 when the fireplace is to be fitted without any back inlet means 15.

Figure 7:
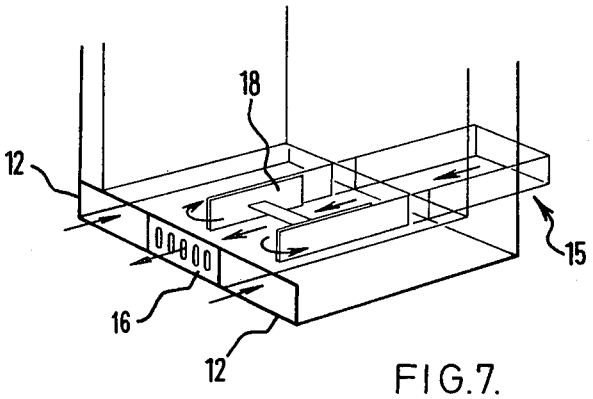
FIGS. 7 to 10 are schematic partial views of the fireplace shown in FIGS. 1 to 4, modified by the inclusion of a valve as shown in FIG. 5, showing different modes of operation.
Figure 8:
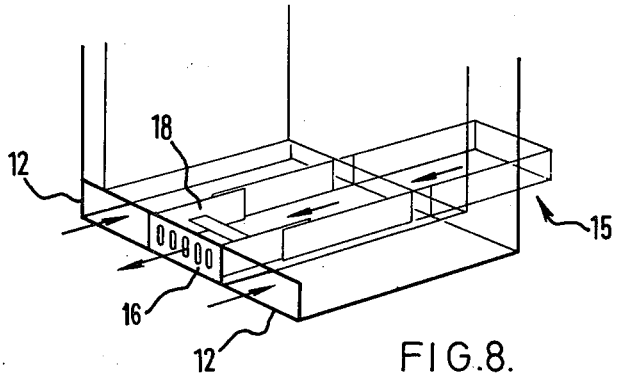
Figure 9:
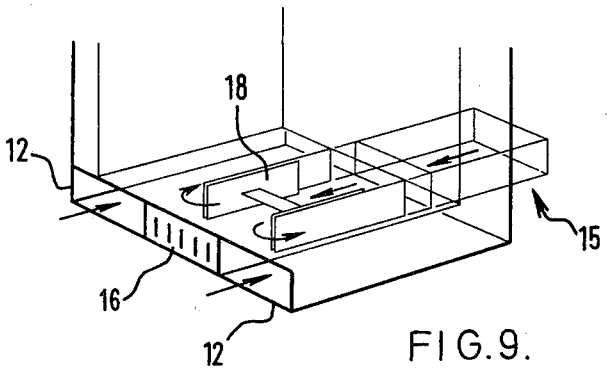
Figure 10:
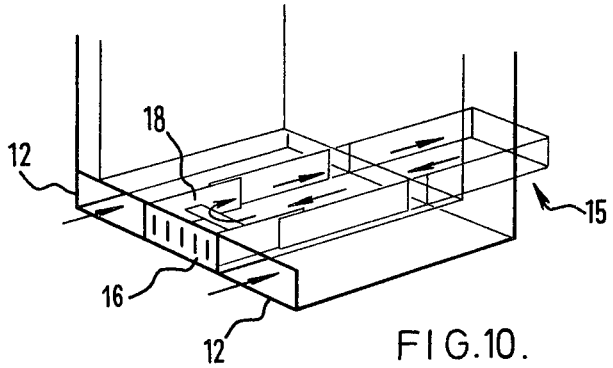

FIGS. 7 to 10 schematically illustrate the different modes of operation of the invention, Thus, as shown in FIG. 7, in normal operation of the fireplace according to the invention, the control vent 16 and the valve 18 are both open. Part of the cold fresh air entering the back inlet means 15 flows into the room, in which the fireplace is situated, through the control vent 16, and the remainder of this cold fresh air joins the convected air entering the fireplace through the front air inlets 12. Where it is required to furnish the fire within the fireplace with more fresh air, the valve 18 is closed, as shown schematically in FIG. 8. In this case, none of the fresh air joins the convected air flow; it all passes into the room and from there into the fire. Conversely, where it is required to diminish the flow of fresh air to the fire, the control vent 16 can be closed instead of the valve 18, as shown in FIG. 9. In this case, all of the fresh air is diverted into the convected air flow. However, it is possible to control this supplementation of the convected air flow by operation of the valve 18 and, an shown in FIG. 10, it is even possible to close the valve 18 completely.

Figure 11:
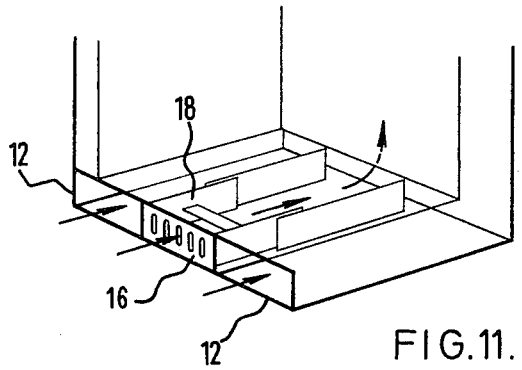
FIG. 11 is a schematic partial view of part of the fireplace shown in FIGS. 1 to 4, showing how this apparatus can be used other than in accordance with the invention.

Finally, as shown in FIG. 11, where it is not possible, in accordance with the invention, to provide the back air inlet means (and the aperture 34 shown in FIG. 2 is closed by the cover plate 66), the control vent 16 serves as an additional, controllable front air inlet for convected air. In this case, flow of combustion air does not depend on it is immaterial whether the valve 18 is opened or closed.

I claim:

1. A fireplace constructed for concurrently controlling the flow of combustion air for a fire in the fireplace and convected air for room heating, comprising:

an open-fronted inner casing, for accommodating a fire, having a rear side panel, an open top panel, a bottom panel, and two lateral side panels;

outer casing means disposed about the inner casing, means for forming separate first and second air spaces within said outer casing means and below the inner casing and means for forming passage means within said outer casing means communicating with the first air space and disposed for providing flow of convected air upwardly from the first air space along at least one of the side panels of the inner casing, the first and second air spaces being adapted for communication therebetween;

first air inlet means communicating with the first air space at the front of the fireplace;

second air inlet means communicating with the second air space for introducing thereto air external to the room to be heated;

air outlet means communicating with the passage means at the front of the fireplace, above the level of the first air inlet means;

valve means operable to vary the extent of communication between the first and second air spaces for varying the flow of air from the second air inlet means, through the second air space, into the first air space; and means for providing communication between said second air space and said inner casing for supplying air from the second air space into the inner casing and having control vent means for controlling the supply of air into the inner casing.

2. A fireplace, according to claim 1, characterized in that the control vent means is located at the front of said second air space and provides communication from the second air space to the inner casing at the front of the fireplace.

3. A fireplace, according to claim 2, in which:

the outer casing means comprises an outer bottom panel which, together with the bottom panel of the inner casing, bounds the first and second air spaces;

said means for forming said first and second air spaces including partition means extending between the bottom panel of the inner casing and the outer bottom panel over part, but not all, of the distance between the second air inlet means and the control vent means to partially separate the first and second air spaces; and the valve means is movable between a closed position in which the valve means cooperates with the partition means to completely separate the first and second air spaces and an open position in which the first and second air spaces are communicatively connected for maximum flow of air between the first and second air spaces.

4. A fireplace, according to claim 3, in which there are two first air spaces respectively disposed on opposite sides of the second air space;

the partition means comprises two partitions which bound opposite sides of the second air space and are respectively disposed between the second air space and the two first air spaces;

the passage means comprises two passageways respectively communicating with the first air spaces for passage of convected air;

the outer casing means comprises two outer side panels which, together with the two lateral side panels of the inner casing, respectively bound the two passageways;

the first air inlet means comprises two front air inlets respectively opening into the two first air spaces; and the air outlet means comprises two front air outlets which are communicatively connected to the two passageways for convected air, respectively.

5. A fireplace, according to claim 4, in which:

the open top panel of the inner casing has two upwardly convergent portions bounding opposite sides of an opening for the escape of smoke;

the outer casing means comprises an outer open top panel which, together with the two upwardly convergent portions of the top panel of the inner casing, bound two laterally separated discharge passages communicatively connected to the two passageways for convected air, respectively; and the two air outlets respectively open from the two laterally separated discharge passages.

6. A fireplace, according to claim 1, in which:

the outer casing means comprises an outer rear panel which is spaced from the rear panel of the inner casing and formed with an opening;

a removable cover plate is mounted on the outer rear panel so as to close the opening; and mounting means is provided for mounting a back boiler above the second air inlet means in the space between the rear panel of the inner casing and the outer rear panel when the cover plate is removed.

7. A fireplace, according to claim 5, in which:

the valve means comprises two side members that are slidable between a closed position, in which the side members cooperate with the partitions to isolate the two first air spaces from the second air space, and an open position, in which the side members lie alongside the partitions;

the control vent means comprises inner and outer apertured plates, one of which is fixed and the other of which is movable so as to vary the registration between apertures formed, respectively, in the inner and outer apertured plates; and a control rod extends through a sliding-fit hole in the movable apertured plate and through a hole formed in the fixed apertured plate and is pivotally connected to the valve means for sliding the side members of the valve means along the partitions and for sliding the movable apertured plate of the control vent means relative to the fixed apertured plate.

* * * * *